US009732306B2

(12) United States Patent
Gonzalez de Cossio et al.

(10) Patent No.: US 9,732,306 B2
(45) Date of Patent: Aug. 15, 2017

(54) FABRIC CONDITIONER CONTAINING A BRANCHED AMINE FUNCTIONAL SILICONE

(71) Applicant: Colgate-Palmolive Company, New York, NY (US)

(72) Inventors: Lucia Gonzalez de Cossio, Qro (MX); Juan Antonio Leon Navarro, Col Irrigacion (MX); Jose Javier Tovar Pescador, Col. Irrigacion (MX); Oscar Bautista Cid, Col. Irrigacion (MX)

(73) Assignee: COLGATE-PALMOLIVE COMPANY, New York, NY (US)

( * ) Notice: Subject to any disclaimer, the term of this patent is extended or adjusted under 35 U.S.C. 154(b) by 109 days.

(21) Appl. No.: 14/654,466

(22) PCT Filed: Dec. 21, 2012

(86) PCT No.: PCT/US2012/071265

§ 371 (c)(1),
(2) Date: Jun. 19, 2015

(87) PCT Pub. No.: WO2014/098897

PCT Pub. Date: Jun. 26, 2014

(65) Prior Publication Data

US 2015/0337239 A1 Nov. 26, 2015

(51) Int. Cl.

| | |
|---|---|
| ***C11D 1/62*** | (2006.01) |
| ***C11D 3/26*** | (2006.01) |
| ***C11D 3/30*** | (2006.01) |
| ***C11D 9/36*** | (2006.01) |
| ***C11D 3/00*** | (2006.01) |
| ***C11D 3/37*** | (2006.01) |

(52) U.S. Cl.
CPC ..... *C11D 3/001* (2013.01); *C11D 3/0026* (2013.01); *C11D 3/3742* (2013.01)

(58) Field of Classification Search
CPC ..... C11D 1/62; C11D 3/001; C11D 3/162; C11D 3/26; C11D 3/30; C11D 3/3742; C11D 9/36; C11D 11/0017
See application file for complete search history.

(56) References Cited

U.S. PATENT DOCUMENTS

| | | | | |
|---|---|---|---|---|
| 3,440,261 | A | 4/1969 | Saam | |
| 4,661,577 | A * | 4/1987 | Jo Lane | D06M 15/6436 106/18.12 |
| 4,800,026 | A * | 1/1989 | Coffindaffer | C11D 3/0015 510/516 |
| 4,806,345 | A | 2/1989 | Bhattacharyya | |
| 4,848,981 | A | 7/1989 | Kasprzak et al. | |
| 5,057,240 | A | 10/1991 | Madore et al. | |
| 5,064,544 | A | 11/1991 | Lin et al. | |
| 5,104,555 | A | 4/1992 | Foster et al. | |
| 5,147,578 | A * | 9/1992 | Kirk | B01D 19/0409 510/513 |
| 5,164,522 | A | 11/1992 | McCarthy et al. | |
| 5,336,419 | A | 8/1994 | Coffindaffer | |
| 5,755,827 | A | 5/1998 | Bamford et al. | |
| 5,858,023 | A | 1/1999 | Bamford et al. | |
| 6,136,215 | A | 10/2000 | Evans et al. | |
| 6,171,515 | B1 | 1/2001 | Evans et al. | |
| 6,747,882 | B2 | 6/2004 | Tanaka et al. | |
| 6,864,223 | B2 | 3/2005 | Smith et al. | |
| 6,908,962 | B1 | 6/2005 | Frankenbach et al. | |
| 7,186,273 | B2 | 3/2007 | Ellis et al. | |
| 7,341,674 | B1 | 3/2008 | Trinh et al. | |
| 2002/0112293 | A1 | 8/2002 | Trinh et al. | |
| 2005/0261461 | A1 | 11/2005 | Maeda et al. | |
| 2005/0272332 | A1 | 12/2005 | Carswell | |
| 2010/0184634 | A1 | 7/2010 | Henault et al. | |
| 2011/0239379 | A1 * | 10/2011 | Hodge | C11D 1/62 8/137 |
| 2011/0243878 | A1 | 10/2011 | Panandiker et al. | |

FOREIGN PATENT DOCUMENTS

| | | |
|---|---|---|
| EP | 0441530 | 6/1994 |
| WO | WO 90/12862 | 11/1990 |
| WO | WO 2004/014983 | 2/2004 |

OTHER PUBLICATIONS

Croda Inc., 2007, "Synperonic NCA Series" Technical Data Sheet.
Croda Inc., 2008, "Cirrasol® PP842A" MSDS.
Dow Corning, 2005, "Q2-1607 Emulsion" Product Information Sheet.
Dow Corning, 2009, "Xiameter® MEM-8203 Emulsion" MSDS.
Dow Corning, 2009, "Xiameter® MEM-8203 Emulsion" Product Information Sheet.
Dow Corning, 2010, "Q2-1607 Emulsion," MSDS.
International Search Report and Written Opinion in International Application No. PCT/US2012/071265, mailed Sep. 23, 2013.
Wilkes et al., 1996, "Characterization of Quaternized Triethanolamine Esters (Esterquats) by HPLC, HRCGC and NMR," 4th World Surfactants Congress, Barcelone, pp. 389-402.
Written Opinion in International Application No. PCT/US2012/071265, mailed Nov. 28, 2014.

* cited by examiner

*Primary Examiner* — Charles Boyer

(57) ABSTRACT

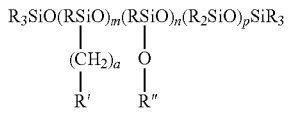

A fabric conditioner composition comprising a branched amine functional silicone, such as an amine functional silicone of structure: The branched amine functional silicone can reduce the time needed for drying fabric and reduce the amount of foam generated during laundering to reduce the amount of water needed for rinsing.

16 Claims, No Drawings

FABRIC CONDITIONER CONTAINING A BRANCHED AMINE FUNCTIONAL SILICONE

BACKGROUND OF THE INVENTION

After laundering of fabric, fabric is rinsed and dried. Drying can be done by line drying or dryer drying. In a dryer, the longer the drying time, the more energy that is used to dry the fabric. Also during laundering, foam can be generated. The more foam that is generated, the more water that is necessary to rinse the fabric. It would be desirable to reduce the time needed to dry fabric and water needed to rinse fabric.

BRIEF SUMMARY OF THE INVENTION

A fabric conditioner composition comprising a branched amine functional silicone The branched amine functional silicone can be of structure

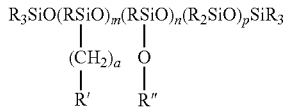

R is a $C_1$-$C_4$ alkyl group,

R' is an amine or salt thereof,

R" is $(R_2SiO)_x$ or $(R_2SiO)_y(RSiO)_w[(CH_2)_3R']_z$, a is 1 to 10, optionally 1 to 5, 1 to 3, or 3, m is 1 to 5, n is 3 to 20, p is 300 to 500, x is 50 to 200, y is 20 to 100, w is 0 to 10, z is 0 to 5; and x+y+w+z+p=500 to 700.

The fabric conditioner can be used in a method to launder fabric to reduce the amount of time needed for drying the fabric.

The fabric conditioner can be used in a method to launder fabric to reduce foam generation during laundering.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION OF THE INVENTION

The following description of the preferred embodiment(s) is merely exemplary in nature and is in no way intended to limit the invention, its application, or uses.

A fabric conditioner composition comprising a branched amine functional silicone. The branched amine functional silicone can be of structure

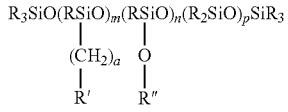

R is a $C_1$-$C_4$ alkyl group,

R' is an amine or salt thereof,

R" is $(R_2SiO)_x$ or $(R_2SiO)_y(RSiO)_w[(CH_2)_3R']_z$, a is 1 to 10, optionally 1 to 5, 1 to 3, or 3, m is 1 to 5, n is 3 to 20, is 300 to 500, x is 50 to 200, y is 20 to 100, w is 0 to 10, z is 0 to 5; and x+y+w+z+p=500 to 700.

The branched amine functional silicone can be obtained from Provista S.A. de C. V of Mexico as Emulsion SR2 silicone.

In certain embodiments, the branched amine functional silicone has a weight average molecular weight of 1,000 to 200,000, optionally, 10,000 to 100,000, or 38,000 to 52,000. In certain embodiments, the molecular weight is about 45,000. In certain embodiments, the branched amine functional silicone is not a film forming polymer. In certain embodiments, at least 80% of R groups in (RSiO) or $(R_2SiO)$ moieties are methyl. In certain embodiments, the amine is selected from the group consisting of —$NH_2$, NHR, —$N(R)_2$, —NH—$(CH_2)_b$–$NH_2$, and —$N(R)_3^+$, wherein b is 1 to 6, optionally 1 to 2, or 2, preferably —$NH_2$. In certain embodiments, R" is $(R_2SiO)_x$.

In certain embodiments, the branched amine functional silicone is present in an amount of 0.02 to 2% by weight of the composition, optionally 0.05 to 1.25%, 0.1 to 1.25%, 0.1 to 0.9%, 0.1 to 0.5%, 0.1 to 0.4%, 0.2 to 0.5%, or 0.3 to 0.4% by weight of the composition.

The branched amine functional silicone reduces the time needed for drying fabric by depositing on the fabric during laundering. The amine groups have an affinity for the fabric and deposit on the fabric. Water on the fabric migrates through the hydrophilic groups on the polymer and then act as a carrier to promote evaporation of the water.

The composition can be used during any step of the laundering method. In one embodiment, the composition is added during the wash cycle. In one embodiment, the composition is added during the rinse cycle. The composition can be used at least 3 times or at least 5 times to launder fabric.

The fabric conditioner can also contain a cationic fabric softener. In certain embodiments, the softener is a cationic softener selected from among esterquats, imidazolinium quats, difatty diamide ammonium methyl sulfate, ditallow dimethyl ammonium chloride, and mixtures thereof.

In certain embodiments, the cationic fabric softener is an esterquat. Esterquats can be of the formula:

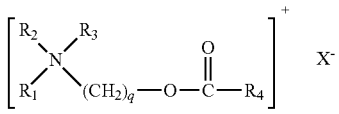

wherein $R_4$ is an aliphatic hydrocarbon group having from 8 to 22 carbon atoms, $R_2$ and $R_3$ represent $(CH_2)_s$—$_5$, where $R_5$ is an alkoxy carbonyl group containing from 8 to 22 carbon atoms, benzyl, phenyl, $C_1$—$C_4$ alkyl substituted phenyl, OH or H; $R_1$ is $(CH_2)_t$-$R_6$, where $R_6$ is benzyl, phenyl, $C_1$-$C_{-4}$ alkyl substituted phenyl, OH or H; q, s, and t, each independently, are an integer from 1 to 3; and $X^-$ is a softener compatible anion.

The percentages, by weight, of mono, di, and tri esterquats, as described above are determined by the quantitative analytical method described in the publication "Characterisation of quaternized triethanolamine esters (esterquats) by HPLC, HRCGC and NMR" A. J. Wilkes, C. Jacobs, G. Walraven and J. M. Talbot—Colgate Palmolive R&D Inc.—4$^{th}$ world Surfactants Congress, Barcelone, 3-7 VI 1996, page 382. The percentages, by weight, of the mono, di and tri esterquats measured on dried samples are normalized on the basis of 100%. The normalization is required due to the presence of 10% to 15%, by weight, of non-quaternized species, such as ester amines and free fatty acids. Accordingly, the normalized weight percentages refer to the pure esterquat component of the raw material. In other words, for the weight % of each of monoesterquat, diesterquat, and triesterquat, the weight % is based on the total amount of monoesterquat, diesterquat, and triesterquat in the composition.

In certain embodiments, the percentage of saturated fatty acids based on the total weight of fatty acids is 45 to 75%. Esterquat compositions using this percentage of saturated fatty acids do not suffer from the processing drawbacks of 100% saturated materials. When used in fabric softening, the compositions provide good consumer perceived fabric softness while retaining good fragrance delivery. In other embodiments, the amount is at least 50, 55, 60, 65 or 70 up to 75%. In other embodiments, the amount is no more than 70, 65, 60, 55, or 50 down to 45%. In other embodiments, the amount is 50 to 70%, 55 to 65%, or 57.5 to 67.5%. In one embodiment, the percentage of the fatty acid chains that are saturated is about 62.5% by weight of the fatty acid. In this embodiment, this can be obtained from a 50:50 ratio of hard:soft fatty acid.

By hard, it is meant that the fatty acid is close to full hydrogenation. In certain embodiments, a fully hydrogenated fatty acid has an iodine value of 10 or less. By soft, it is meant that the fatty acid is no more than partially hydrogenated. In certain embodiments, a no more than partially hydrogenated fatty acid has an iodine value of at least 40. In certain embodiments, a partially hydrogenated fatty acid has an iodine value of 40 to 55. The iodine value can be measured by ASTM D5554-95 (2006). In certain embodiments, a ratio of hard fatty acid to soft fatty acid is 70:30 to 40:60. In other embodiments, the ratio is 60:40 to 40:60 or 55:45 to 45:55. In one embodiment, the ratio is about 50:50. Because in these specific embodiments, each of the hard fatty acid and soft fatty acid cover ranges for different levels of saturation (hydrogenation), the actual percentage of fatty acids that are fully saturated can vary. In certain embodiments, soft tallow contains approximately 47% saturated chains by weight.

The percentage of saturated fatty acids can be achieved by using a mixture of fatty acids to make the esterquat, or the percentage can be achieved by blending esterquats with different amounts of saturated fatty acids.

The fatty acids can be any fatty acid that is used for manufacturing esterquats for fabric softening. Examples of fatty acids include, but are not limited to, coconut oil, palm oil, tallow, rape oil, fish oil, or chemically synthesized fatty acids. In certain embodiments, the fatty acid is tallow.

While the esterquat can be provided in solid form, it is usually present in a solvent in liquid form. In solid form, the esterquat can be delivered from a dryer sheet in the laundry. In certain embodiments, the solvent comprises water.

AI refers to the active weight of the combined amounts for monoesterquat, diesterquat, and triesterquat. Delivered AI refers to the mass (in grams) of esterquat used in a laundry load. A load is 3.5 kilograms of fabric in weight. As the size of a load changes, for example using a smaller or larger size load in a washing machine, the delivered AI adjusts proportionally. In certain embodiments, the delivered AI is 2.8 to 8 grams per load. In other embodiments, the delivered AI is 2.8 to 7, 2.8 to 6, 2.8 to 5, 3 to 8, 3 to 7, 3 to 6, 3 to 5, 4 to 8, 4 to 7, 4 to 6, or 4 to 5 grams per load.

The cationic fabric conditioner, such as esterquat, can be present in an amount of 0.5 to 20% by weight of the composition. In other embodiments, the amount is 1 to 20, 1 to 15, or 1 to 10% by weight.

The composition can be provided as a fragrance free composition, or it can contain a fragrance. The amount of fragrance can be any desired amount depending on the preference of the user. In certain embodiments, the total amount of fragrance oil is 0.3 to 3 weight % of the composition. The fragrance can be in free form, encapsulated, or both.

Fragrance, or perfume, refers to odoriferous materials that are able to provide a desirable fragrance to fabrics, and encompasses conventional materials commonly used in detergent compositions to provide a pleasing fragrance and/or to counteract a malodor. The fragrances are generally in the liquid state at ambient temperature, although solid fragrances can also be used. Fragrance materials include, but are not limited to, such materials as aldehydes, ketones, esters and the like that are conventionally employed to impart a pleasing fragrance to laundry compositions. Naturally occurring plant and animal oils are also commonly used as components of fragrances.

The composition can contain any material that can be added to fabric softeners. Examples of materials include, but are not limited to, surfactants, thickening polymers, colorants, clays, buffers, silicones, fatty alcohols, and fatty esters.

The fabric conditioners may additionally contain a thickener. In one embodiment, the thickening polymer is the FLOSOFT™ DP200 polymer from SNF Floerger that is described in U.S. Pat. No. 6,864,223 to Smith et al., which is sold as FLOSOFT™ DP200, which as a water soluble cross-linked cationic polymer derived from the polymerization of from 5 to 100 mole percent of cationic vinyl addition monomer, from 0 to 95 mole percent of acrylamide, and from 70 to 300 ppm of a difunctional vinyl addition monomer cross-linking agent. A suitable thickener is a water-soluble cross-linked cationic vinyl polymer which is cross-linked using a cross-linking agent of a difunctional vinyl addition monomer at a level of from 70 to 300 ppm, preferably from 75 to 200 ppm, and most preferably of from 80 to 150 ppm. These polymers are further described in U.S. Pat. No. 4,806,345, and other polymers that may be utilized are disclosed in WO 90/12862. Generally, such polymers are prepared as water-in-oil emulsions, wherein the cross-linked polymers are dispersed in mineral oil, which may contain surfactants. During finished product making, in contact with the water phase, the emulsion inverts, allowing the water soluble polymer to swell. The most preferred thickener is a cross-linked copolymer of a quaternary ammonium acrylate or methacrylate in combination with an acrylamide comonomer. The thickener in accordance provides fabric softening compositions showing long term stability upon storage and allows the presence of relatively high levels of electrolytes without affecting the composition stability. Besides, the fabric softening compositions remain stable when shear is applied thereto. In certain embodiments, the amount of this thickening polymer is at least 0.001 weight %. In other embodiments, the amount is 0.001 to 0.35 weight %.

The fabric conditioner may further include a chelating compound. Suitable chelating compounds are capable of chelating metal ions and are present at a level of at least 0.001%, by weight, of the fabric softening composition, preferably from 0.001% to 0.5%, and more preferably 0.005% to 0.25%, by weight. The chelating compounds which are acidic in nature may be present either in the acidic form or as a complex/salt with a suitable counter cation such as an alkali or alkaline earth metal ion, ammonium or substituted ammonium ion or any mixtures thereof. The chelating compounds are selected from among amino carboxylic acid compounds and organo aminophosphonic acid compounds, and mixtures of same. Suitable amino carboxylic acid compounds include: ethylenediamine tetraacetic acid (EDTA); N-hydroxyethylenediamine triacetic acid; nitrilotriacetic acid (NTA); and diethylenetriamine pentaacetic acid (DEPTA). Suitable organo aminophosphonic acid compounds include: ethylenediamine tetrakis (methylenephosphonic acid); 1-hydroxyethane 1,1-diphosphonic acid (HEDP); and aminotri (methylenephosphonic acid). In certain embodiments, the composition can include amino tri methylene phosphonic acid, which is available as Dequest™2000 from Monsanto. In other embodiments, the composition can include glutamic acid, N,N-diacetic acid, tetra sodium salt, which is available as Dissolvine™ GL from AkzoNobel.

In certain embodiments, the composition can include a $C_{13}$-$C_{15}$ Fatty Alcohol EO 20:1, which is a nonionic surfactant with an average of 20 ethoxylate groups. In certain embodiments, the amount is 0.05 to 0.5 weight %.

In certain embodiments, the composition can contain a silicone as a defoamer, such as Dow Corning™ 1430 defoamer or Antifom™ 1086 manufactured by Provista. In certain embodiments, the amount is 0.05 to 0.8 weight %.

In certain embodiments, the composition can additionally contain cetyl trimethyl ammonium chloride. In certain embodiments, cetyl trimethyl ammonium chloride is present in an amount of 0.001 to 5 weight %. In certain embodiments, the cetyl trimethyl ammonium chloride is present in the emulsion of the polymer. In this emulsion, the amount of cetyl trimethyl ammonium chloride is 2 to 8 weight % of the emulsion, or 0.001 to 0.6 weight % of the composition. When included, the cetyl trimethyl ammonium chloride in combination with the branched amine functional silicone reduces foam generation during laundering, which reduces the amount of rinsing needed.

SPECIFIC EMBODIMENTS

In the examples below, amounts of material are based on the as supplied weight of the material.

Preparation Method

Weigh required amount of distilled water in a beaker. Add amino trimethyl phosphonic acid and lactic acid to water and mix. Heat to 40° C. Stir the solution using an overhead stirrer at 250 RPM for 2 minutes. In a beaker, heat esterquat to 65° C. Add esterquat into solution while stirring at 400 RPM. Mix the solution for 10 minutes. Add SNF™ polymer into the solution and stir for 10 minutes. Add the polyether polymer into solution while stirring at 250 RPM. Mix the solution for 5 minutes. Check the temperature of the mixture. On cooling to room temperature, add any fragrance drop wise.

Fabric Treatment with Fabric Softener

Prepare an approximate 1.8 kg load containing 5 denim swatches (100% cotton denim, 35×35 cm long, approximately 50 g per swatch) with 1.6 kg of ballast load, per product to be tested (washing machine).

Weigh each Swatch and record measurement

Using a marking pen, label swatches with respective product identification code.

Weigh out detergent samples and fabric softener for each wash.

Washing machine(s) should be cleaned by conducting a wash cycle.

Washer Type: Top Load

Wash Cycle: Normal Cycle

Wash Time: 55 minutes

Water Level: 43 liters used for each wash and rinse cycles

Wash Temperature: Room Temperature

Rinse Temperature: Room Temperature

Laundry Load Size 1.8 Kg

Detergent: Ariel™ Oxianillos detergent from Mexico

Dosage: 90 g

Fabric Softener: 110 g

Set wash controls for custom cycle with specified wash period. Add detergent and fabric softener to respective compartments in washing machine. Add swatches and ballast load to washing machine.

Start wash cycle

Wash for specified amount of time

Remove wash load & swatches for hand wash rinsing.

All the garments treated are rinsed and hung to dry without wringing. The garment are allowed to hang for 5 Minutes to drip the excess of water and then weighed.

35 cm denim swatches are evaluated during the experiment (35 cm×35 cm). Up to 5 denim swatches are evaluated per treatment as repetitions in order to avoid the experimental error. The percent water retained is shown below compared to a fabric conditioner without the polymer and a comparative of rinsing with water.

| Material (weight %) | Comparative | Example |
|---|---|---|
| Tetranyl ™ AHT5090 Esterquat from Kao | 7.8 | 7.8 |
| Lactic acid (80% active) | 0.0625 | 0.0625 |
| Dequest ™ 2000 amino trimethyl phosphonic acid | 0.05 | 0.05 |
| FLOSOFT ™ DP200 thickening polymer | 0.135 | 0.135 |
| The branched amine functional silicone polymer (30% polymer) | 0 | 2 |
| Water and minors (fragrance, preservative, color) | Q.S. to 100 | Q.S. to 100 |

TABLE 1

| Sample | Water Retention (%) |
|---|---|
| Inventive with polymer | 85.3 |
| Control softener without polymer | 87.5 |
| Wash with water only | 89.3 |

As can be seen in the table above, the inventive composition with the polymer had less water retention, which would require less drying.

The % Water Retention is calculated based in the following formula $$\%\ \text{Water Retention} = \frac{(WeightWet - WeightDry)}{WeightDry}$$

Example 2

The following compositions are made to be tested to determine the reduction in foaming.

| Material (weight %) | Comparative | Example |
|---|---|---|
| Tetranyl ™ AHT5090 Esterquat from Kao | 6.7 | 6.7 |
| Lactic acid (80% active) | 0.0625 | 0.0625 |
| Dequest ™ 2000 amino trimethyl phosphonic acid | 0.1 | 0.1 |
| FLOSOFT ™ DP200 thickening polymer | 0.2 | 0.2 |
| Antifom ™ 1086 silicone defoamer manufactured by Provista | 0.12 | 0.12 |
| C14-15 Alcohol ethoxylate 20EO | 0.4 | 0.4 |
| The branched amine functional silicone polymer (30% polymer) as supplied amount | 0 | 1 or 2 |
| Water and minors (fragrance, preservative, color) about 85.5% water for the comparative | Q.S. to 100 | Q.S. to 100 |

Each of the above compositions are added at 110 ml into a container of water with 60 liters of water.

10 long sleeve shirts are dipped five times into the containers to simulate rinsing. The shirts are evaluated by five panelists according to the foam generation scale. 1 is no foam, 2 is slight foam, 3 is moderate foam, 4 is abundant foam, and 5 is very abundant foam. The average of the ratings for all shirts are in the Table 2 below.

TABLE 2

| Sample | Rating |
|---|---|
| Control | 3.36 |
| 1% polymer | 2.93 |
| 2% polymer | 2.5 |

It can be seen that the amount of foam generated is reduced when the branched amine functional silicone polymer is included.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

We claim:

1. A fabric conditioner composition comprising a branched amine functional silicone, wherein the branched amine functional silicone has a structure of

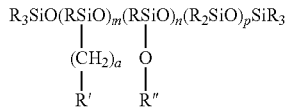

R is a $C_1$-$C_4$ alkyl group,
R' is an amine or salt thereof,
R" is $(R_2SiO)_x$ or $(R_2SiO)_y(RSiO)_w[(CH_2)_3R']_z$,
a is 1 to 10, optionally 1 to 5, 1 to 3, or 3,
m is 1 to 5,
n is 3 to 20,
is 300 to 500,
x is 50 to 200,
y is 20 to 100,
w is 0 to 10,
z is 0 to 5; and
x+y+w+z+p=500 to 700.

2. The fabric condition of claim 1, wherein the branched amine functional silicone has a weight average moleculaer weight of 1,000 to 200,000.

3. The fabric conditioner of any preceding claim 1, wherein the branched amine functional is not a film forming polymer.

4. The fabric conditioner of claim 1, wherein at least 80% of R groups in (RSiO) or $(R_2SiO)$ moieties are methyl.

5. The fabric conditioner of claim 1, wherein the amine is selected from the group consisting of —$NH_2$, NHR, —$N(R)_2$, —NH—$(CH_2)_b$—$NH_2$, and —$N(R)_3^+$, wherein b is 1 to 6.

6. The fabric conditioner of claim 2, wherein the amine is —$NH_2$.

7. The fabric conditioner of claim 1, wherein R" is $(R_2SiO)_x$.

8. The fabric conditioner of claim 1, wherein the branched amine functional silicone is present in an amount of 0.02 to 2% by weight of the composition.

9. The fabric conditioner claim 1, further comprising a cationic fabric softener.

10. The fabric conditioner of claim 9, wherein, the cationic fabric conditioner is present in an amount of 0.5 to 20% by weight of the composition.

11. The fabric condition of claim 9, wherein the cationic fabric conditioner is present an esterquat.

12. The fabric conditioner of claim 1, wherein the composition is an aqueous composition.

13. The fabric conditioner of claim 1, wherein the composition further comprises cetyl trimethyl ammonium chloride.

14. A method for reducing time needed for drying fabric comprising laundering the fabric with the composition of claim 1.

15. The method of claim 14, wherein the laundering is repeated at least 3 times.

16. A method for reducing foam generation during laundering of fabric comprising laundering the fabric with the composition of claim 1.

* * * * *